US008869780B2

(12) United States Patent
Mashita

(10) Patent No.: US 8,869,780 B2
(45) Date of Patent: Oct. 28, 2014

(54) ATTACHMENT STRUCTURE OF VACUUM PUMP

(75) Inventor: Daijiro Mashita, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 254 days.

(21) Appl. No.: 13/312,076

(22) Filed: Dec. 6, 2011

(65) Prior Publication Data

US 2012/0145135 A1 Jun. 14, 2012

(30) Foreign Application Priority Data

Dec. 9, 2010 (JP) ..... 2010-274923

(51) Int. Cl.
*F01M 13/00* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS

| | | | | |
|---|---|---|---|---|
| 3,279,444 | A | 10/1966 | Leasure | |
| 3,662,723 | A | 5/1972 | Buhl | |
| 4,656,991 | A * | 4/1987 | Fukuo et al. | 123/572 |
| 4,840,152 | A * | 6/1989 | Watanabe et al. | 123/41.08 |
| 5,239,972 | A | 8/1993 | Takeyama | |
| 5,647,337 | A * | 7/1997 | Johnson et al. | 123/572 |
| 6,279,555 | B1 * | 8/2001 | Crowell et al. | 123/572 |
| 7,051,721 | B2 * | 5/2006 | Tomita et al. | 123/572 |
| 7,367,328 | B2 | 5/2008 | Matsuda | |
| 2007/0095335 | A1 | 5/2007 | Matsuda | |
| 2009/0107425 | A1 * | 4/2009 | Saito | 123/41.86 |

FOREIGN PATENT DOCUMENTS

| | | |
|---|---|---|
| JP | 57-000320 | 1/1982 |
| JP | S57-183510 | 11/1982 |
| JP | H03-124906 | 5/1991 |
| JP | 5-60000 A | 3/1993 |
| JP | H06-123212 | 5/1994 |
| JP | H06-346712 | 12/1994 |
| JP | 2002-276317 | 9/2002 |
| JP | 2007-120411 A | 5/2007 |

OTHER PUBLICATIONS

European Search Report issued in European Patent Application No. 11185399.0 dated Mar. 28, 2012.

Japanese Office Action dated Sep. 2, 2014, which issued during prosecution of Japanese Application No. 2010-274923, which corresponds to the present application.

* cited by examiner

*Primary Examiner* — M. McMahon
(74) *Attorney, Agent, or Firm* — Troutman Sanders LLP

(57) ABSTRACT

The inside in an engine case is sucked to turn a pressure in the engine case into a negative pressure. A breather chamber is disposed above a vacuum pump. An intake port of a blow-by gas is disposed in an upper portion of the vacuum pump. A discharge port of the blow-by gas is disposed in a lower portion of the vacuum pump.

8 Claims, 9 Drawing Sheets

ATTACHMENT STRUCTURE OF VACUUM PUMP

CROSS-REFERENCE TO RELATED APPLICATIONS

This application is based upon and claims the benefit of priority of the prior Japanese Patent Application No. 2010-274923, filed on Dec. 9, 2010, the entire contents of which are incorporated herein by reference.

BACKGROUND OF THE INVENTION

1. Field of the Invention

The present invention relates to an attachment structure of a vacuum pump for causing a negative pressure in an engine case in an engine, particularly in a four-cycle engine, of a vehicle such as a motorcycle.

2. Description of the Related Art

Conventionally, a four-cycle engine to be mounted in, for example, a motorcycle or the like is designed such that reciprocations of pistons to move in cylinder blocks are converted to rotation of a crankshaft housed in an engine case and motive power by the rotation of the crankshaft is output to the outside. In such a four-cycle engine, due to an increase in the number of rotations of the engine, various losses in terms of a machine, (which are referred to as what is called mechanical losses), are increased, and as one of the losses, a pumping loss is known. Here, the pumping loss means pressure resistance to the reciprocations of the pistons and is mainly ascribable to an air containing a blow-by gas in the engine case.

In order to reduce such a pumping loss, conventionally various devices have been made in an engine as has been disclosed in Patent Document 1, for example. That is, the engine disclosed in Patent Document 1 includes a vacuum pump to operate in conjunction with rotation of a crankshaft; and an air chamber communicating with an engine case, in which a negative pressure is caused in the air chamber by the vacuum pump. By the vacuum pump to operate in accordance with the number of rotations of the crankshaft, an air in the engine case is sucked and thus a negative pressure is always maintained in the engine case.

Further, an engine disclosed in Patent Document 2 is further designed such that an air mixed with gas and liquid in an engine case in which a crankshaft is housed is subjected to gas/liquid separation in a breather chamber provided upstream or downstream of a pump, and the discharge side of the pump is connected to intake and exhaust paths of a combustion chamber.

[Patent Document 1] Japanese Laid-open Patent Publication No. 05-60000

[Patent Document 2] Japanese Laid-open Patent Publication No, 2007-120411

However, when the breather chamber is provided between the engine and the pump, a task of pressurizing a gas having a small content of oil to discharge the pressurized gas is required for the pump. That is, the pump is required to have durability sufficient to endure self-heating in an adiabatic compression process and to maintain high airtightness even through a temperature environment is changed. Further, when the breather chamber is provided between the pump and the intake path or the exhaust path, the oil content passing through the pump chamber acts effectively for sealing performance and cooling performance, but a process of compressing the oil content causes a large mechanical loss, and thus if the breather chamber is provided as described above, an effect of reducing the pumping loss is canceled.

Particularly, in a V-type engine, a cylinder head, an intake pipe, and an exhaust pipe are disposed and constituted at an upper portion of an engine case. It is often difficult to dispose the breather and pump each having a sufficient capacity in such a restricted space.

SUMMARY OF THE INVENTION

In consideration of such a situation, the present invention has an object to provide an attachment structure of a vacuum pump achieving a breather function that is always excellent effectively and a reduction in pumping loss.

An attachment structure of a vacuum pump according to the present invention being an attachment structure of a vacuum pump sucking the inside of an engine case to turn a pressure in the engine case into a negative pressure, the attachment structure of the vacuum pump includes: disposing a breather chamber above the vacuum pump.

The attachment structure of the vacuum pump of the present invention further includes: disposing an intake port of a blow-by gas in an upper portion of the vacuum pump.

The attachment structure of the vacuum pump of the present invention further includes: disposing a discharge port of the blow-by gas in a lower portion of the vacuum pump.

The attachment structure of the vacuum pump of the present invention further includes: setting a rotor shaft of the vacuum pump to be coaxial with a rotor shaft of an oil pump.

The attachment structure of the vacuum pump of the present invention further includes: disposing the breather chamber in one side surface of a crankcase.

The attachment structure of the vacuum pump of the present invention further includes: disposing the breather chamber in the middle of the crankcase between banks on both sides in a V-type engine.

The attachment structure of the vacuum pump of the present invention further includes: setting the rotor of the vacuum pump to a Roots blower.

DETAILED DESCRIPTION OF THE PREFERRED EMBODIMENTS

Hereinafter, a preferred embodiment of an attachment structure of a vacuum pump in the present invention will be explained based on the drawings.

Figure 1:
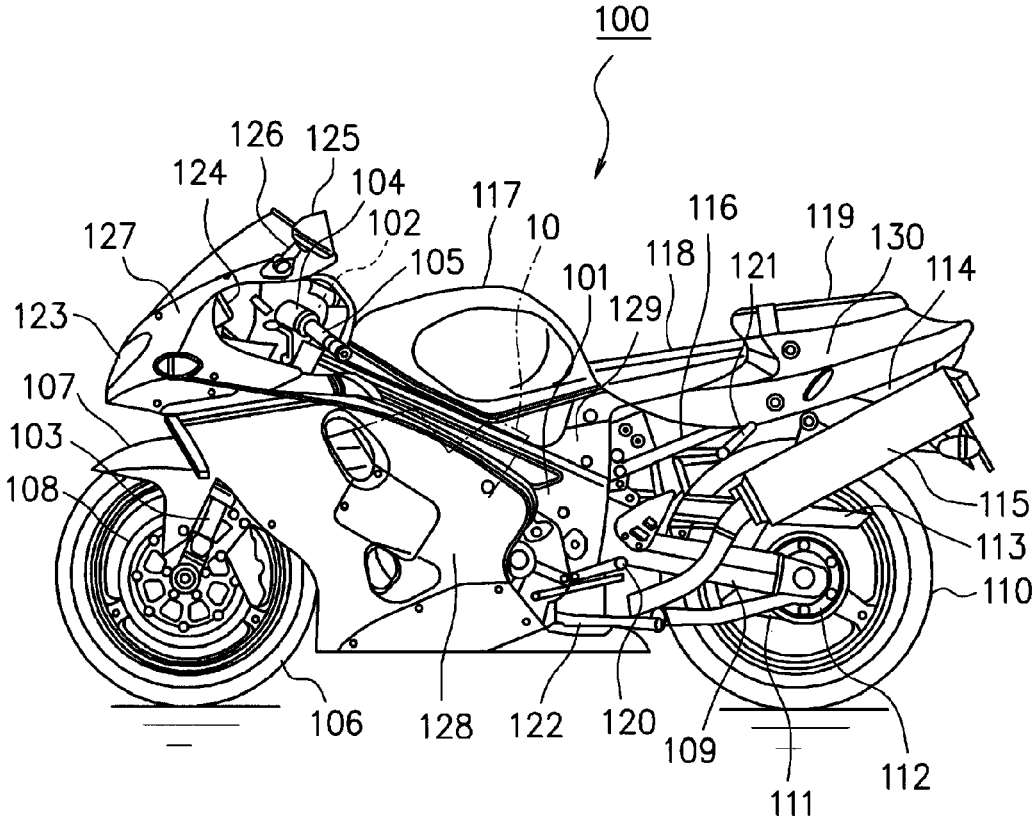
FIG. 1 is a side view showing an example of the entire constitution of a motorcycle according to an embodiment of the present invention.

First, the entire structure of a vehicle to which the present invention is applied will be explained. In this embodiment, a motorcycle 100 as shown in FIG. 1 is set, and a vacuum pump is disposed in an engine mounted in the above motorcycle 100 as will be described later. Incidentally, in each of the drawings used in the following explanation, the front of the vehicle is indicated by an arrow Fr, the rear of the vehicle is indicated by an arrow Rr, the lateral right side of the vehicle is indicated by an arrow R, and further the lateral left side of the vehicle is indicated by an arrow L according to need.

In FIG. 1, at a front portion of a vehicle body frame 101 made of steel or an aluminum alloy material, right and left two front forks 103 supported to be turnable right and left by a steering head pipe 102 are provided. A handle bar 104 is fixed to upper ends of the front forks 103, and grips 105 are provided at both ends of the handle bar 104. A for wheel 106 is rotatably supported on lower portions of the front forks 103, and a front fender 107 is fixed to the lower portions of the front forks 103 so as to cover an upper portion of the front wheel 106. T front wheel 106 has a brake disc 108 that rotates integrally with the front wheel 106.

The vehicle body frame 101 is branched into a two-pronged shape on the right and left from the steering head pipe 102 toward the rear, and each slantly extends rearward and downward. Swing arms 109 are coupled to rear portions of the vehicle body frame 101 in a swingable manner, and a rear shock absorber is laid between the swing arms 109. A rear wheel 110 is rotatably supported on rear ends of the swing arms 109. The rear wheel 110 is designed to be rotationally driven via a driven sprocket 112 around which a chain 111 to transmit motive power of the later-described engine is wound. Incidentally, a chain cover 113 is provided above the chain 111, and a rear fender 114 is disposed above the rear wheel 110.

A later-described engine unit 10 is mounted on the vehicle body frame 101, an air-fuel mixture is supplied from a fuel supply system to the above engine unit 10, and an exhaust gas after combustion in the engine is exhausted through an exhaust pipe. In this embodiment, the engine may also be a four-cycle multicylinder (four-cylinder) engine, for example. Further, the engine can also be constituted such that exhaust pipes of respective cylinders are coupled no one another on the lower side of the engine unit 10, and thereafter an exhaust gas flows through an exhaust chamber to be exhausted from a muffler 115 in the vicinity of a rear end of the vehicle. Incidentally, the muffler 115 is attached and supported with the use of a seat rail 116 and so on that support a later-described seating seat and so on.

A fuel tank 117 is mounted above the engine unit 10, and at the rear of the fuel tank 117, a rider seat 118 and a tandem seat 119 are consecutively provided. Foot rests 120 and foot rests 121 (pillion steps) are disposed corresponding to the rider seat 118 and the tandem seat 119. In this example, on the left side of the vehicle, a prop stand 122 is provided at a substantially central lower portion in the front and rear direction. Further, in FIG. 123 denotes a head lamp, 124 denotes a meter unit including a speedometer, a tachometer, various indicator lamps, and so on, and 125 denotes rear mirrors supported on a fairing 127 via stays 126.

As for the exterior of the vehicle, mainly a front portion and side portions of the vehicle are covered with the fairing 127 and side cowls 128, a rear portion of the vehicle is covered with side covers 129 and a seat cowl 130, and thereby an appearance form of the vehicle, which has what is called a streamlined shape, is formed. Further, at a front end portion of the fairing 127, an air intake port for supplying air to an air cleaner, (of which detailed illustration is omitted), is opened. Incidentally, the present invention is not limited only to the vehicle in such an appearance type, and is also applicable to other cases.

Figure 2:
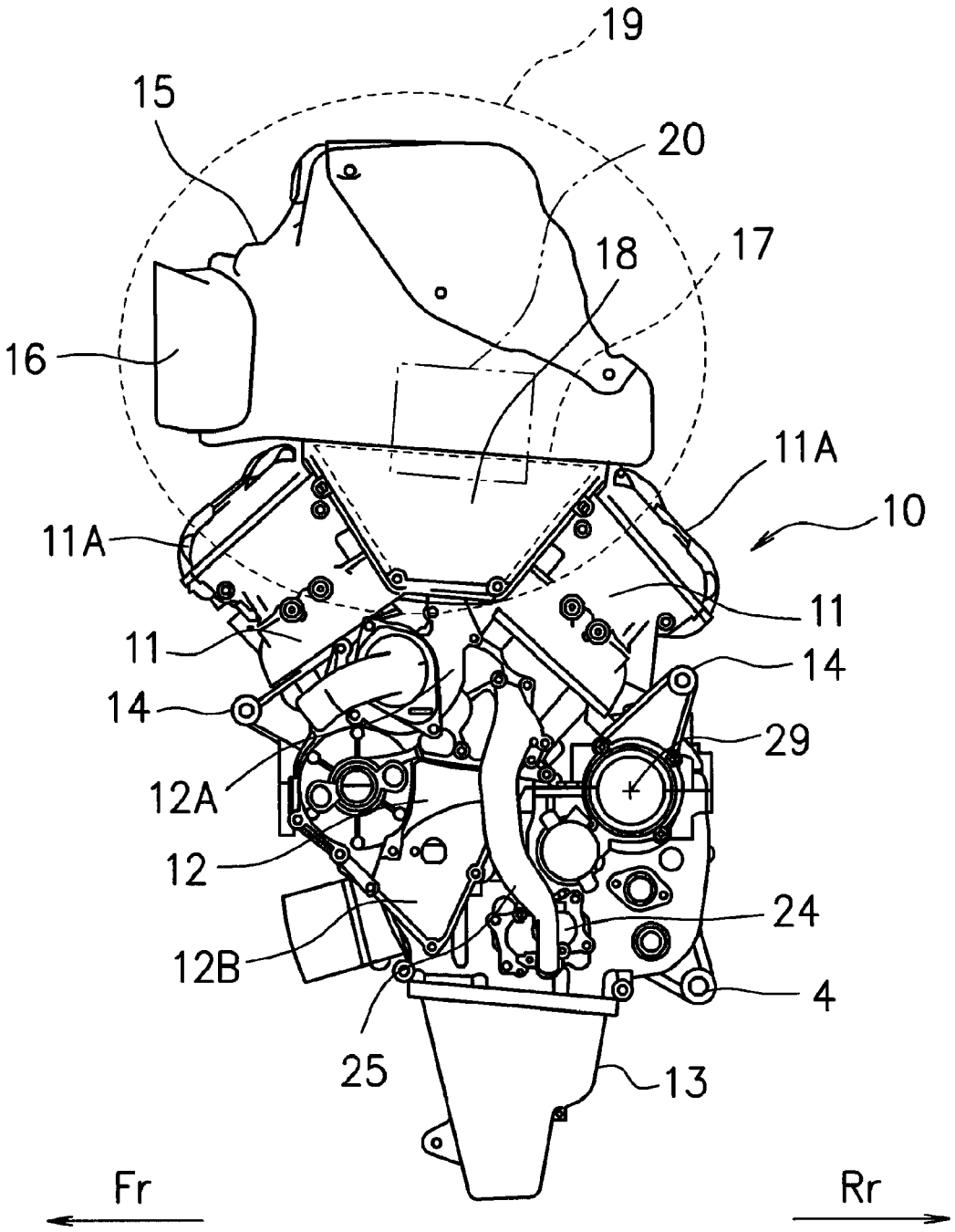
FIG. 2 is a side view showing a constitution example of an engine unit according to the embodiment of the present invention.

Next, FIG. 2 shows a concrete constitution example of the periphery of the engine unit 10 in this embodiment. In this example, what is called a V-type engine is set, and in the engine unit 10, V-shaped banks are formed by cylinders (or cylinder blocks) 11 disposed at the front and rear respectively (in a side view), and a crankcase 12 that is divided into an upper part and a lower part (that are an upper crankcase 12A and a lower crankcase 12B) is integrally coupled under the cylinder blocks 11. Incidentally, the engine is a multicylinder engine having two cylinders or more, and by these cylinders, the front bank and the rear bank of the V-shaped banks are constituted. An oil pan 13 is provided at a bottom portion of the engine unit 10, namely on the lower side of the lower crankcase 12B. The engine unit 10 is integrally coupled to the vehicle body frame 101 via a plurality of engine mounts 14 and functions as a rigid member of the vehicle body frame 101 in itself.

An air cleaner 15 for supplying clean air to an intake system is disposed on the upper side of cylinder head covers 11A of the cylinder blocks 11. The air cleaner 15 has an air filter and so on housed therein, basically has a hollow structure having a predetermined volume, and is completely housed and maintained between right and left main frames of the vehicle body frame 101. Further, an air duct is connected to a front end portion of the air cleaner 15 via an air intake part 16, is extended to the front of the air cleaner 15, and is opened at a front end portion of the vehicle as the previously described air intake port.

Figure 3:
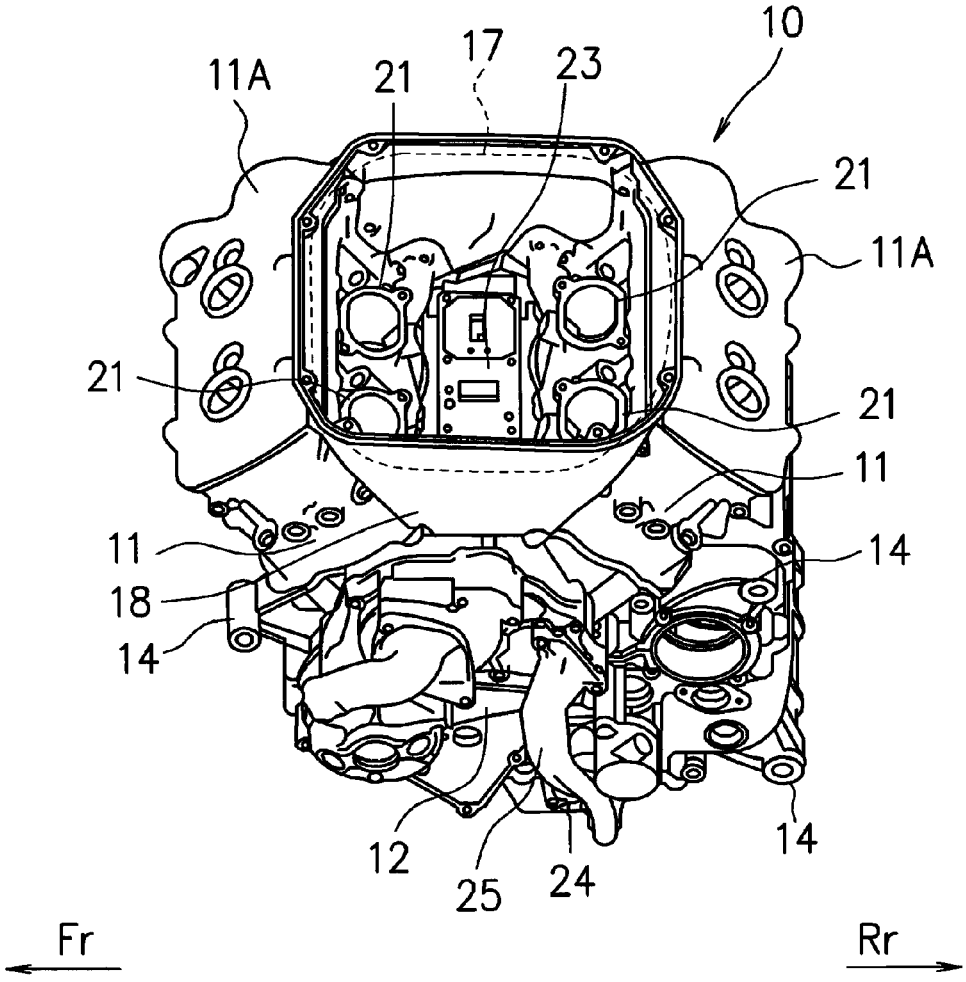
FIG. 3 is a perspective view showing a state where an air cleaner is removed in the engine unit according to the embodiment of the present invention.

A V-bank space 17 in a substantially inverted triangle shape in a side view is formed between the V-shaped banks constituted by the front and rear cylinders 11, and right and left ends of the above V-bank space 17 are covered with side covers 18 as shown in FIG. 2 and FIG. 3. The side covers 18 are integrally coupled to the cylinders 11. Further, the above-described air cleaner 15 is mounted on the upper side or the V-bank space 17, namely the V-bank space 17 is closed by the air cleaner 15 and the side covers 18, and is brought into a sealed state practically. The above V-bank space 17 and the inside of the air cleaner 15 communicate with each other, and here, an air box 19 is defined by both these spaces, and in the above air box 19, the fuel supply system, an intake system 20, and so on are disposed and constituted.

Figure 4:
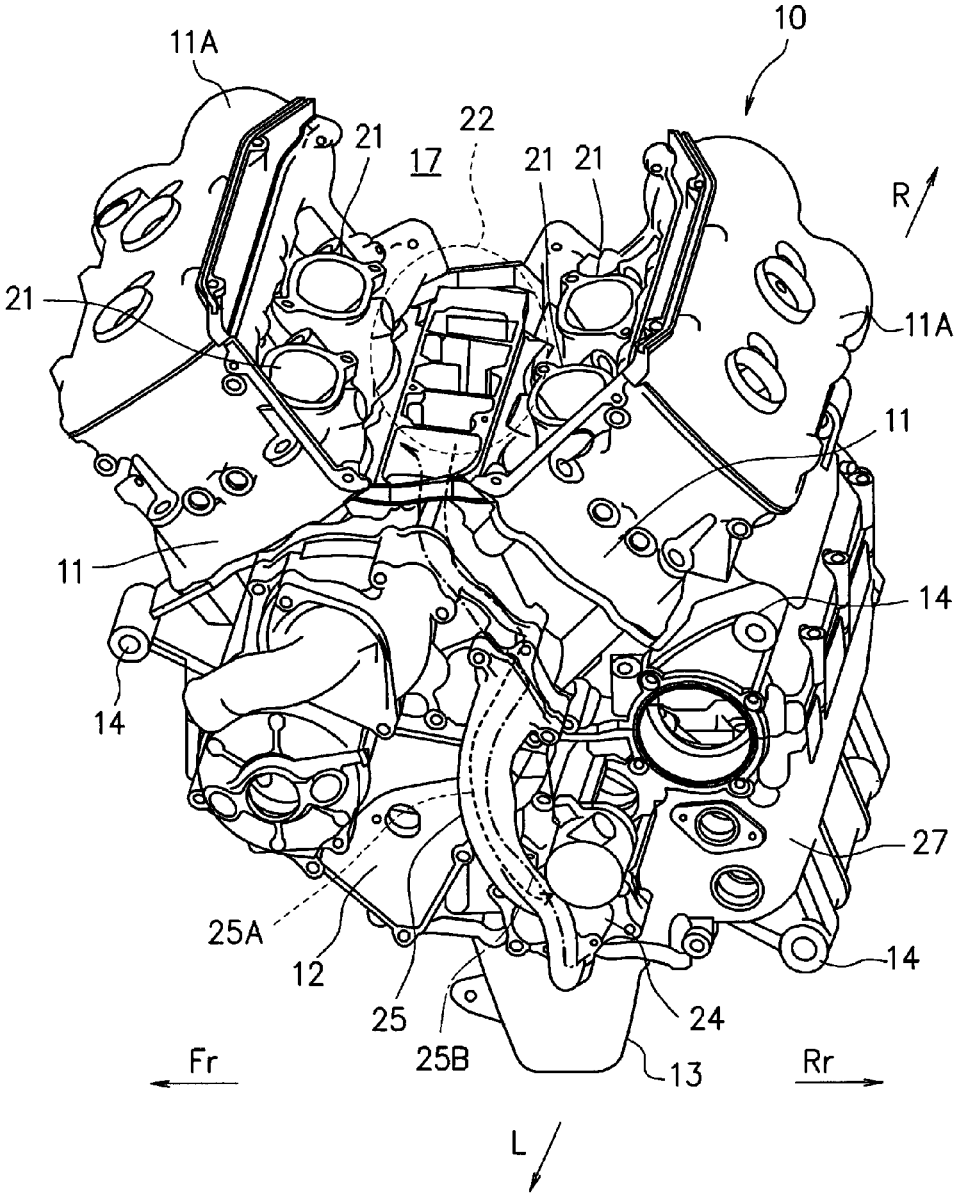
FIG. 4 is a perspective view showing a state where the air cleaner and side covers are removed in the engine unit according to the embodiment of the present invention.

The engine unit 10 in this embodiment has a V-type four-cylinder engine as shown in FIG. 3 and FIG. 4, and in the front and rear banks of the V-shaped banks, the two cylinders 11 are each juxtaposed right and left. Intake pipes 21 are provided to all the respective cylinders 11 to project toward the V-bank space 17, and not-shown throttle bodies are coupled and disposed to the upper side of the intake pipes 21, which is the upstream side of the flow of intake air.

Then, in the present invention, as shown in FIG. 4, a positive-displacement breather chamber 22 is provided to be positioned at a central lower portion of the V-bank space 17, namely at a bottom portion of the V shape. The breather chamber 22 is separated from the V-bank space 17 by a cover 23 laid at an upper end portion of the breather chamber 22 as shown in FIG. 3, namely the breather chamber 22 is disposed under the cover 23. The above breather chamber 22, similarly to the ordinary case, is disposed at a position as high as possible in the engine unit 10 in order to facilitate intake of an air having a small oil content, and also in this example, the breather chamber 22 communicates with the upper crankcase 12A of the crankcase 12. Then, the breather chamber 22 is designed to take in an air containing a blow-by gas in an engine case to separate the air into gas and liquid.

On the other hand, as shown in FIG. 2 or FIG. 4, a vacuum pump 24 for causing a negative pressure in the engine case is disposed at a lower portion of the engine unit 10. The vacuum pump 24 is driven by rotation of a crankshaft as will be described later, and has a function of sucking an air in the engine case to turn the pressure in the engine case into a negative pressure. The breather chamber 22 or particularly the V-bank space 17 in the air box 19 and the vacuum pump 24 communicate with each other via a gas supply pipe 25 mainly.

Figure 5A:
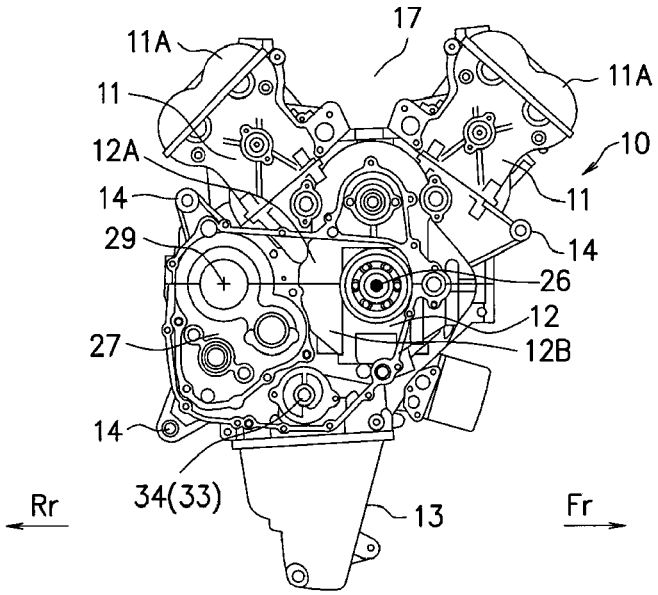
FIG. 5A and FIG. 5B are a right side view and a left side view each showing a main constitution of the periphery of a crankcase in the engine unit according to the embodiment of the present invention.
Figure 5B:
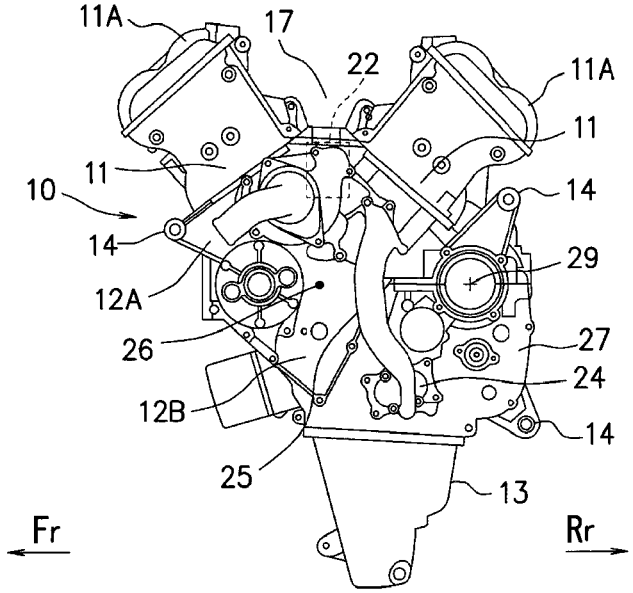
Figure 6:
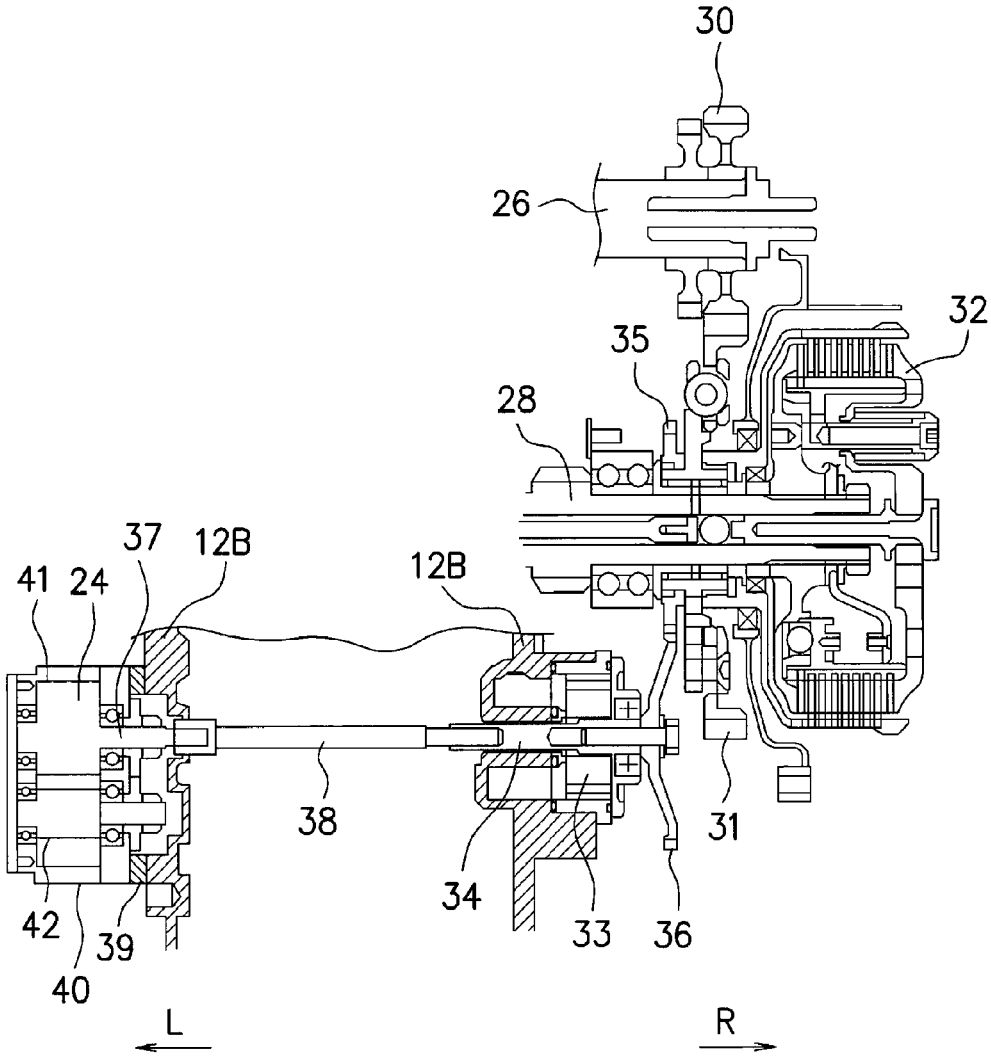
FIG. 6 is a cross-sectional view showing a disposition constitution example of an oil pump and a vacuum pump in the engine unit according to the embodiment of the present invention.

Here, with reference to FIG. 5, FIG. 6, and so on, a concrete attachment structure or disposition structure of the vacuum pump 24, and so on will be explained. First, a crankshaft 26 coupled to pistons to reciprocate in the respective cylinders 11 that form the V-shaped banks in the engine unit 10 is easily rotatably supported on a joining surface of the upper crankcase 12A and the lower crankcase 12B, and in a transmission case 27 formed to extend to the rear side of the crankcase 12, as shown in FIG. 6, a countershaft 28 and a drive shaft 29 are arranged at the front and rear in parallel to the crankshaft 26 respectively. A primary drive gear 30 is attached to a right, end portion of the crankshaft 26, a primary driven gear 31 is axially supported on the right end side of the countershaft 28 to be easily rotatable, and further a clutch device 32 is provided to the right of the primary driven gear 31. The primary drive gear 30 and the primary driven gear 31 always engage.

Gears on the driving side are provided in a row on the countershaft 28 along an axial direction thereof, and gears on the driven side that correspondingly engage with the gears on the side of the countershaft 28 are provided in a row on the drive shaft 29 along an axial direction thereof, of which illustrations are omitted. A transmission gear composed of these gears moves on the countershaft 28 and the drive shaft 29 by a not-shown shift mechanism, and thereby the drive shaft 29 is rotationally driven at a desired gear ratio. On the left end side of the drive shaft 29, a drive sprocket provided to project outward from a side wall of the transmission case 27 is provided, and rotation of the above drive sprocket rotationally drives the rear wheel 110 via the chain 111.

Further, as shown in FIG. 6, an oil pump 33 for supplying a lubricating oil to respective parts of the engine is disposed in the vicinity of the lower side of the countershaft 28. The oil pump 33, as shown in FIG. 5A, has a rotor shaft 34 thereof disposed in the vicinity of a lower portion of the lower crankcase 12B and attached to a side wall of the lower crankcase 12B so as to be parallel to the countershaft 28 as shown in FIG. 6. Further, the oil pump 33 is positioned above the oil pan 13. Further, as shown in FIG. 6, a gear 35 that rotates integrally with the primary driven gear 31 axially supported on the countershaft 28 and a gear 36 attached to the rotor shaft 34 of the oil pump 33 engage with each other, and thereby the rotation of the countershaft 28 drives the oil pump 33.

In the above-described case, the vacuum pump 24 has the rotor shaft 37 thereof disposed coaxially with the rotor shaft 34 of the oil pump 33 and attached to the outside of the side wall of the lower crankcase 12B. The rotor shaft 37 of the vacuum pump 24 is coupled to the rotor shaft 34 of the oil, pump 33 via a coupling rod 38. Thus, the vacuum pump 24 is positioned above the oil can 13 similarly to the oil pump 33. As described previously, the breather chamber 22 is disposed at the central lower portion of the V-bank space 17, and as is clear also from FIG. 5B and so on, there is a considerable difference in level between the breather chamber 22 and the vacuum pump 24. In the above case, as shown in FIG. 6, typically, a heat shield plate 39 made of Bakelite is inserted between the part to which the vacuum pump 24 is attached and the side wall of the lower crankcase 12B, and this makes it possible to reduce a rise in temperature of the vacuum pump 24 caused by heat generation by the engine.

The vacuum pump 24 and the breather chamber 22 or the air box 19 communicate with each other via the gas supply pipe 25 as described previously. Here, in a concrete constitution example of the vacuum pump 24, a Roots blower is used in this embodiment. A Roots pump as above is excellent in following ability to the change in rotation speed of the engine because internal mass is small. Further, in the vacuum pump 24, a movable part necessary for lubrication and a Roots blower part that compresses and feeds an air are separated, so that the vacuum pump 24 can endure high-speed rotation even though the Roots blower part has no lubrication.

Figure 7B:
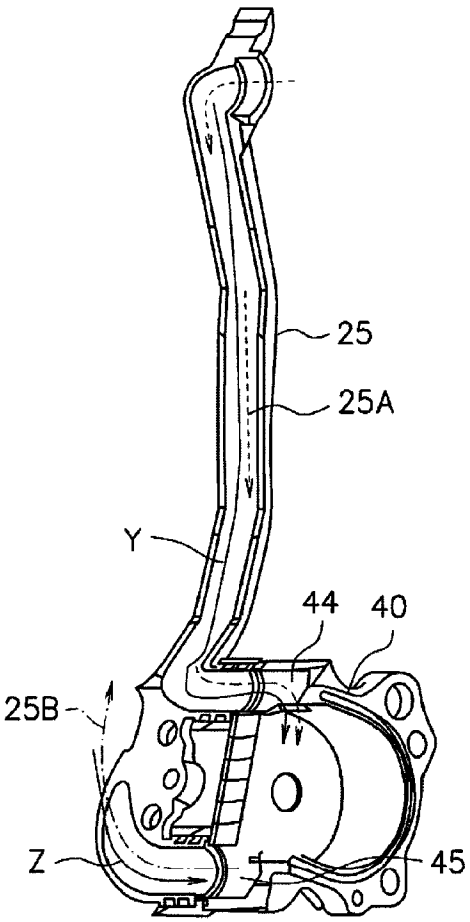
FIG. 7A and FIG. 7B are perspective views showing a substantial constitution of the vacuum pump and a connection relationship of the vacuum pump and a gas supply pipe according to the embodiment of the Present invention respectively.
Figure 7A:
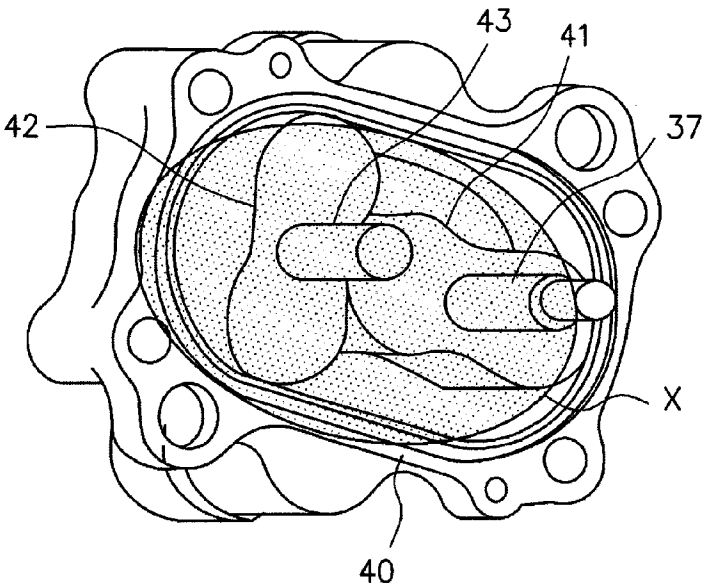

As shown in FIG. 7A and FIG. 7B, the vacuum pump 21 has a driving rotor 41 and a driven rotor 42 rotatably housed in a casing 40. The driving rotor 41 is axially supported on the rotor shaft 37, and the driven rotor 42 is axially supported on a rotor shaft 43. Further, an intake port 44 communicating with the inside of the casing 40 is provided in an upper portion of the casing 10, and a discharge port 45 communicating with the inside of the casing 40 is provided in a lower portion of the casing 40. The driving rotor 41 is rotated by the rotor shaft 37, and thereby the driven rotor 42 is driven-rotated. Thereby, an air or gas taken in from the intake port 44 is discharged from the discharge port 45.

The gas supply pipe 25, as shown also in FIG. 4, has an intake-side pipeline 25A connected to the intake port 44 and a discharge-side pipeline 25B connected to the discharge port 45, and in this example, the intake-side pipeline 25A and the discharge-side pipeline 25B are formed in the single gas supply pipe 25. When the gas supply pipe 25 is attached to the engine unit 10, an end portion, of the intake-side pipeline 25A, opposite to the vacuum pump 24 is connected to an intake path 46 formed from the breather chamber 22 through the lower crankcase 12B and one portion of an engine cover, as indicated by a dotted line in FIG. 8. An end portion, of the discharge-side pipeline 25B, opposite to the vacuum pump 24, as indicated by a one-dot chain line in FIG. 9, is connected to a discharge path 47 formed through the engine cover and one portion of the lower crankcase 12B to communicate with the air box 19.

In the above-described constitution, when the engine is started, the crankshaft 26 rotates to operate a valve moving device, a transmission, and so on, and then an ordinary engine operating state is made. At this time, the rotation of the crankshaft 28 operates the oil pump 33 to thereby supply a lubricating oil appropriately to the parts required to be lubricated in the engine unit 10. Further, at this time, some blow-by gas is generated in the engine case simultaneously, but the vacuum pump 24 coupled to the oil pump 33 operates to effectively suck the blow-by gas through the breather chamber 22.

Figure 8:
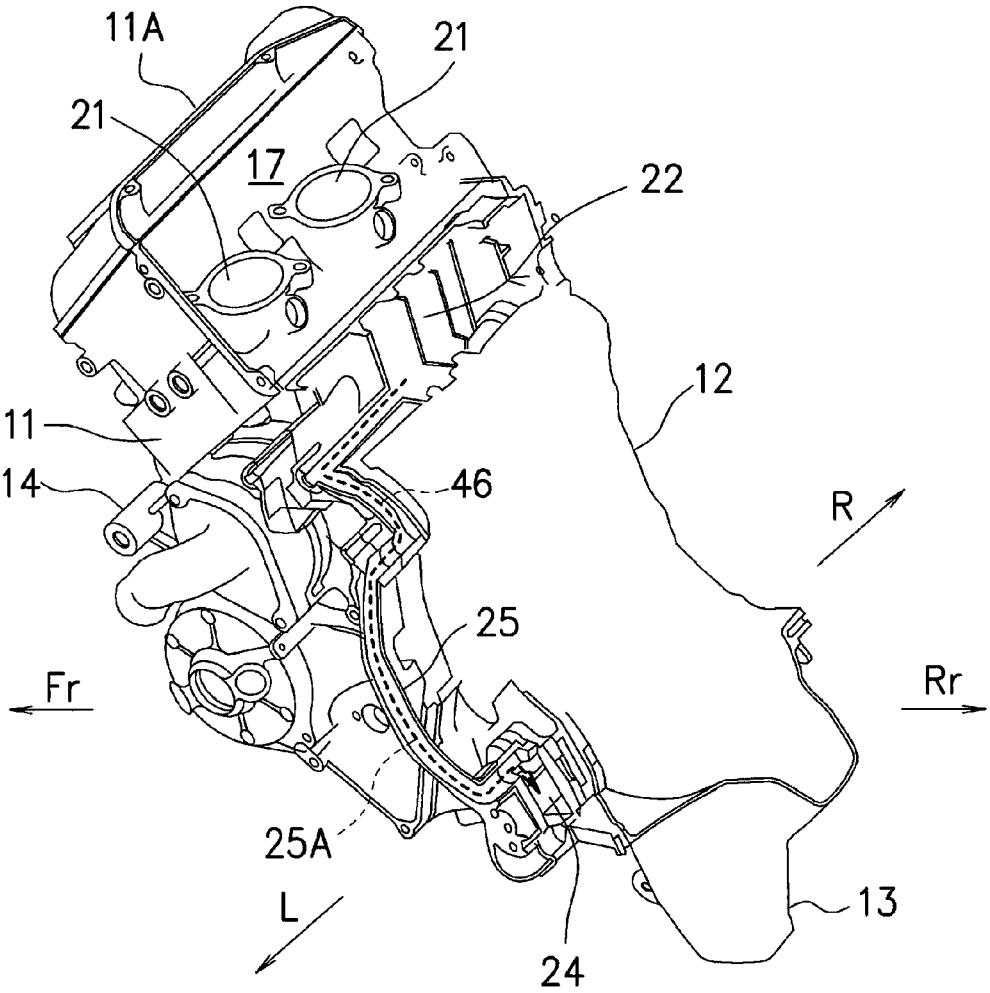
FIG. 8 is a perspective view showing a connection disposition relationship of the vacuum pump and an intake-side pipeline according to the embodiment of the present invention.
Figure 9:
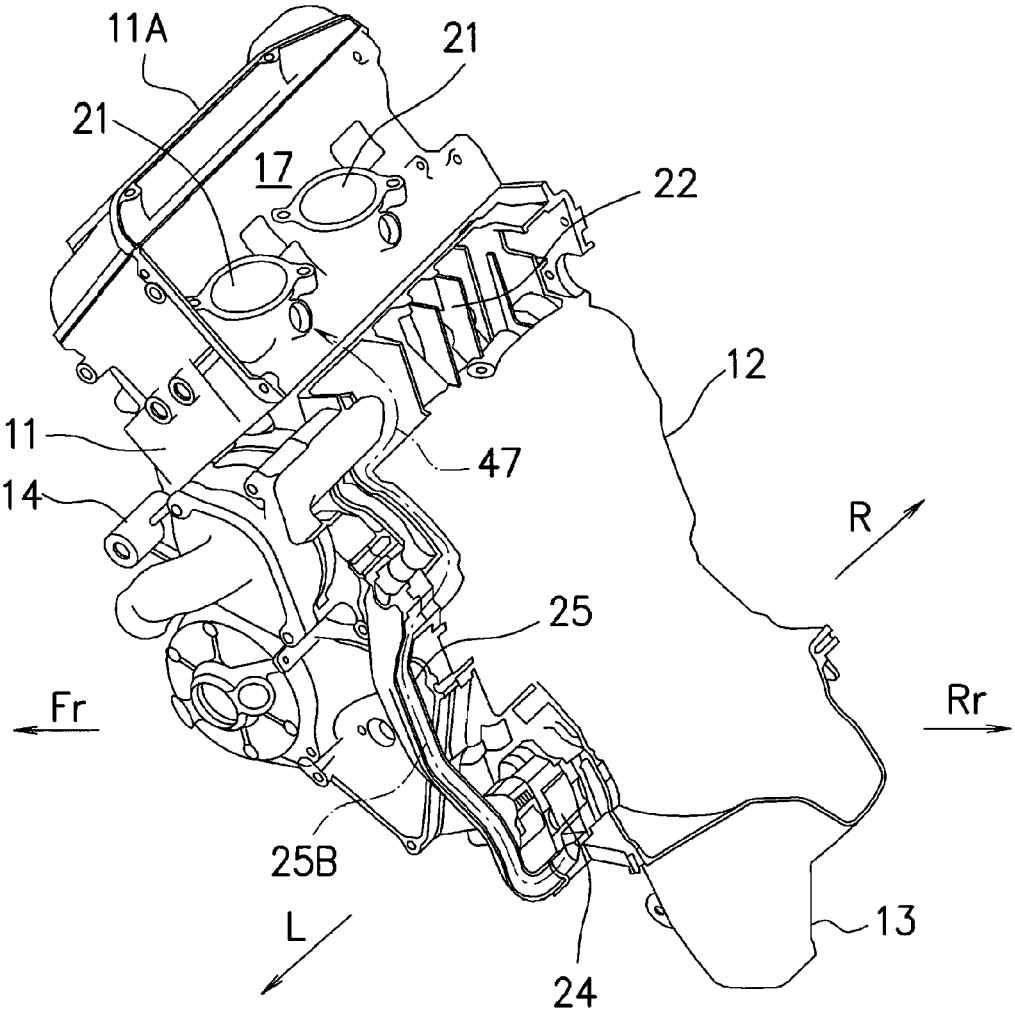
FIG. 9 is a perspective view showing a connection disposition relationship of the vacuum pump and a discharge-side pipeline according so the embodiment of the present invention.

In this embodiment, the breather chamber 22 or the air box 19 and the oil pump 33 are connected by the gas supply pipe 25, and when the vacuum pump 24 operates, the inside of the breather chamber 22 is first sucked via the intake-side pipeline 25A as shown in FIG. 8. Gas/liquid separation of the blow-by gas sucked into the breather chamber 22 from the engine case progresses in the breather chamber 22, and an air having a small oil content of the blow-by gas is taken in the vacuum pump 24. The vacuum pump 24, as shown in FIG. 9, discharges the air into the air box 19 through the discharge-side pipeline 25B, and an intake gas containing the air is supplied to the engine again through the intake pipes 21 by the intake system.

The characteristic operation and effect of the present invention will be explained. First, the breather chamber 22 is disposed above the vacuum pump 24 as shown in FIG. 5B and so on.

When such a disposition relationship of the breather chamber 22 and the vacuum pump 24 is established, even though the blow-by gas containing oil mist is sucked from the breather chamber 22, the vacuum pump 24 is disposed below the breather chamber 22 and thus the oil drops down to a sliding portion (a region X in FIG. 7A) in the vacuum pump 24 positioned below due to the difference in level between the breather chamber 22 and the vacuum pump 24. Then, a reduction in abrasion and improvement of durability of the siding portion in the vacuum pump 24 are thereby achieved. Further, the oil content of the blow-by gas allows sealing between the driving rotor 41 and the driven rotor 42 and the casing 40 in the vacuum pump 24, and this makes it possible to increase pump efficiency of the vacuum pump 24.

As described above, by leading the oil content contained in the air to the vacuum pump 24 disposed at a lower portion of the engine from the breather chamber 22 disposed between the V-shaped banks of the cylinders 11, the oil content can be effectively utilized for lubricating the periphery of the rotors in the vacuum pump 24. Further, the oil content contained in the air can increase the pump efficiency by a sealing effect of the periphery of the rotors.

Further, the intake port 44 of the blow-by gas is disposed in the upper portion of the vacuum pump 24. When the intake port 44 is disposed in this manner, the oil contained in the blow-by gas drops down to the above-described sliding portion in the vacuum pump 24 as indicated by an arrow Y in FIG. 7B to thereby be able to lubricate the above sliding portion efficiently.

On the other hand, the discharge port 45 of the blow-by gas is disposed in the lower portion of the vacuum pump 24. When the discharge port 45 is disposed in this manner, the oil dropped down to the intake side of the vacuum pump 24, as indicated by an arrow Z in FIG. 7B, goes down along a wall surface of the casing 40 from the intake side, thereby allowing lubrication between the driving rotor 41 and the driven rotor 42 and the wall surface of the casing 40 to be performed effectively.

Further, the rotor shaft 37 of the vacuum pump 24 is set coaxially with the rotor shaft 34 of the oil pump 33.

By coaxially rotating the rotors for the vacuum pump 24 and a rotor for the oil pump 33, it becomes, possible to drive both the pumps efficiently. Further, the rotors are coaxially disposed, and thereby it is possible to achieve a reduction in size of a device.

Further, the breather chamber 22 is disposed in one side surface of the crankcase 12. That is, as shown in FIG. 5B, for example, the breather chamber 22 is disposed at the rear of the front bank of the V-shaped banks structured by the cylinders 11.

When the breather chamber 22 is disposed in this manner, the breather chamber 22 adjacent to the cylinder blocks 11 is depressurized by the vacuum pump 24, and thus it is possible to effectively reduce a pumping loss.

In the above case, the breather chamber 22 is disposed in the middle of the crankcase 12 between the V-shaped banks in the V-type engine in this embodiment.

As is in this embodiment, when the breather chamber 22 is disposed in the middle of the crankcase 12 between the V-shaped banks in the V-type engine, it is possible to equally suck both the insides of the front crankcase 12 and the rear crankcase 12 by the vacuum pump 24 efficiently.

Further, in this embodiment, a Roots blower is employed for the rotors of the vacuum pump 24. The employment of a Roots blower having good pump efficiency makes it possible to effectively improve the performance of the vacuum pump 24.

In the foregoing, the present invention has been explained with various embodiments, but the present invention is not limited only to these embodiments and may be changed within the scope of the present invention.

In the above-described embodiment, a Roots blower is employed in the vacuum pump, but another pump type such as a gear type, a plunger type, or a Lysholm type may also be employed. Further, besides the crankshaft employed as a pump driving source, it is also possible to utilize, for example, an electric motor, engine exhaust pressure, or the like.

Further, an example where an air is discharged into the portion adjacent to the breather chamber from the vacuum pump has been explained, but the present invention may also be designed to make the air flow back to the air cleaner 15 directly.

Furthermore, besides the V-type engine, the present invention is similarly applicable to an inline multicylinder engine, for example, and operation and effect similar to those of the above-described embodiment can be obtained.

According to the present invention, by leading the oil content contained the air no the vacuum pump disposed at the lower portion of the engine from the breather chamber disposed between the cylinders, typically between the V-shaped banks, the oil content can be effectively utilized for lubricating the periphery of the rotors in the vacuum pump. Further, the oil content contained in the air can increase the Pump efficiency by a sealing effect of the periphery of the rotors.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An attachment structure of a vacuum pump for sucking an inside of an engine case to turn a pressure in the engine case into a negative pressure, comprising:

the vacuum pump attached to a position outside of a side wall of a crankcase;

a breather chamber provided above the vacuum pump;

an air box provided above the vacuum pump;

wherein the vacuum pump comprises:

an intake-side pipeline comprising a first end communicating with an intake port of the vacuum pump and a second end communicating with the breather chamber; and a discharge-side pipeline comprising a first end communicating with a discharge port of the vacuum pump and a second end communicating with the air box; and wherein, when the vacuum pump operates, a blow-by gas is sucked from the breather chamber through the intake-side pipeline, and is discharged into the air box through the discharge-side pipeline.

2. The attachment structure of the vacuum pump according to claim 1, further comprising:

an intake port of a blow-by gas provided in an upper portion of the vacuum pump.

3. The attachment structure of the vacuum pump according to claim 2, further comprising:

a discharge port of the blow-by gas provided in a lower portion of the vacuum pump.

4. The attachment structure of the vacuum pump according to claim 1, further comprising:

a rotor shaft of the vacuum pump set to be coaxial with a rotor shaft of an oil pump.

5. The attachment structure of the vacuum pump according to claim 1, wherein the breather chamber is provided in one side surface of a crankcase.

6. The attachment structure of the vacuum pump according to claim 1, wherein the breather chamber is provided in a middle of a crankcase between banks on both sides in a V-type engine.

7. The attachment structure of the vacuum pump according to claim 1, wherein the vacuum pump has a Roots blower.

8. The attachment structure of the vacuum pump according to claim 3, further comprising:

a flow path of blow-by gas, connected to the discharge port of the vacuum pump and extending upward from the discharge port of the vacuum pump.

* * * * *